United States Patent [19]

Zappa

[11] Patent Number: 4,762,487

[45] Date of Patent: Aug. 9, 1988

[54] DIODE SUPPLIED PULSED COMBUSTOR

[75] Inventor: Oswald L. Zappa, Stoneham, Mass.

[73] Assignee: Gas Research Institute, Chicago, Ill.

[21] Appl. No.: 84,817

[22] Filed: Aug. 13, 1987

[51] Int. Cl.[4] ..... F23C 11/04

[52] U.S. Cl. ..... 431/1; 431/346; 431/114

[58] Field of Search ..... 431/1, 346, 114; 432/25, 58; 60/247, 39.76, 39.77; 34/191

[56] References Cited

U.S. PATENT DOCUMENTS

| | | | |
|---|---|---|---|
| 2,898,978 | 8/1959 | Kitchen et al. | 431/1 |
| 3,087,532 | 4/1963 | Beach et al. . | |
| 3,171,465 | 3/1965 | Rydberg . | |
| 3,194,295 | 6/1965 | Marchal et al. . | |
| 3,333,620 | 8/1967 | Morse | 431/346 |
| 3,395,967 | 8/1968 | Karr | 431/1 |
| 4,045,157 | 8/1977 | Peterson | 431/114 |
| 4,080,149 | 3/1978 | Wolfe | 431/1 |
| 4,260,361 | 4/1981 | Huber | 431/1 |
| 4,457,691 | 6/1984 | Hisaoka et al. | 431/1 |
| 4,637,794 | 1/1987 | Gray et al. | 432/58 |
| 4,671,056 | 6/1987 | Genz et al. | 431/1 X |

*Primary Examiner*—Randall L. Green

*Attorney, Agent, or Firm*—Melvin E. Frederick

[57] ABSTRACT

A pulsed combustor comprising at least one aerodynamic diode, a diffuser, fuel injectors, combustion chamber/duct, igniters, and muffler providing plug type flow with successive ignition and wave generation at the hot gas interface of the previous pulse. The downstream wave of each pulse propagates through the muffler whereas the upstream wave of each such pulse is at least partially reflected downstream with the diode(s) and diffuser minimizing reverse flow and maximizing pressure gain in the cumbustor.

11 Claims, 2 Drawing Sheets

DIODE SUPPLIED PULSED COMBUSTOR

This invention relates to pulsed combustors and more particularly to pulsed combustors for drying of particulate material, preheating processing.

BACKGROUND OF THE INVENTION

Pulse combustion drying is a recognized technique for effecting heat processing of particulate material. Illustrative of some prior art techniques are U.S. Pat. Nos. 3,618,655; 4,226,668; 4,226,670; 4,265,617 and 2,838,869.

Typically, pulse combustors require an acoustic resonator. Such combustors have high local combustion intensity and high local heat release. However, they also are subject to limited pressure gain and require a large resonator volume.

Broadly, pulsed combustors or burners resemble a two cycle gasoline engine, in which fuel and air are sucked into a combustion chamber, the mixture is caused to explode and then exhausted from the combustion chamber for its intended use. When the mixture explodes the pressure in the combustion chamber increases greatly and, typically, closes a flapper valve or the like thereby preventing both continued inflow of the mixture and outflow of products of combustion in the upstream direction. Where no valve is used a resonant chamber downstream of the combustion chamber provides more or less the same result. Under this condition, the combustion gas is exhausted through the resonator to the point of use, thereby creating a negative pressure which permits entry of a new quantity of the mixture in the combustion chamber and the cycle is then repeated.

SUMMARY OF THE INVENTION

The present invention is a pulsed combustor comprising at least one aerodynamic diode, a diffuser, fuel injectors, combustion chamber/duct, igniters, and muffler providing plug type flow with successive ignition and wave generation at the hot gas interface of the previous pulse. The downstream wave of each pulse propagates through the muffler whereas the upstream wave of each such pulse is at least partially reflected downstream with the diode(s) and diffuser minimizing reverse flow and maximizing pressure gain in the combustor.

The present invention eliminates the need for the large acoustic resonators of the prior art, alleviates the problems of noise and vibration in the burner itself, controls the shape and magnitude of the pressure pulses transmitted from the burner to succeeding components, and provides improved heat transfer and particle separation. Pulsed combustors in accordance with the present invention produce combustion which is controlled to provide very high pressure gain together with a very compact overall combustor system.

The very compact scale and high pressure gain provided by the present invention provides a highly attractive package for applications such as particle heating followed by cyclone separation. In such an application sufficient pressure gain is provide to permit highly efficient batch heating and subsequent inertial separation of the batch material.

Further, the plug type flow provided by the present invention minimizes the time necessary to purge the combustor of hot gases prior to the injection of fuel and ignition for subsequent pulses. The diffuser in addition to providing a transition from a preferable small diode outlet port to a much larger combustor cross section also results in a reflection of waves propagating upstream.

Other objects and advantages of the present invention will be apparent from the following description and appended drawings.

DESCRIPTION OF THE PREFERRED EMBODIMENT

Figure 1:
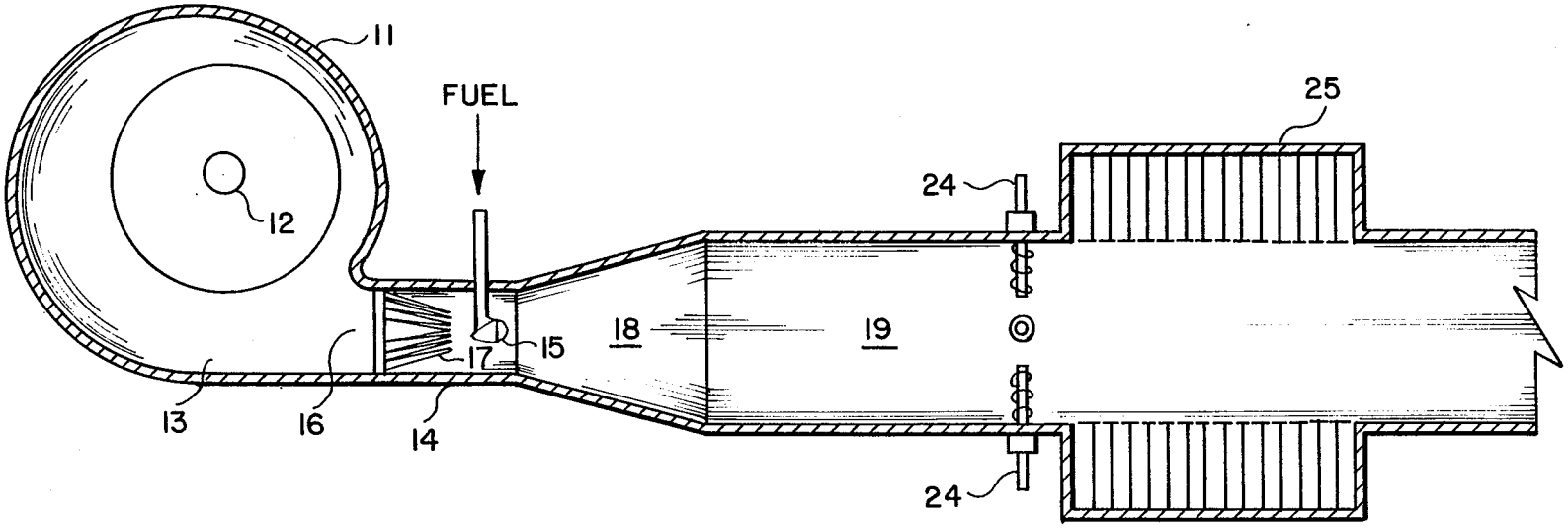
FIG. 1 is a diagrammatic side elevation in cross section showing one embodiment of a pulsed combustor in accordance with the invention.

Referring now to FIG. 1 there is shown a pulsed combustor in accordance with the invention comprising an aerodynamic vortex diode 11 having an air inlet 12 and an air outlet 13. A duct 14 receives air from air outlet 13 and disposed within duct 14 is fuel injection means. Disposed at the air outlet 16 of duct 14 is a flow diode 17 more fully discussed hereinafter communicating with a diffuser 18 increasing in cross section in the direction of air flow. While the use of gas as a fuel is preferred, any other fuel may be used.

For the embodiment shown, mixing of air and fuel occurs in both duct 14 and diffuser 18. However, the point of fuel injection may be otherwise than as shown and mixing may occur in the combustion chamber 19 or elsewhere. Igniters 24, while shown as disposed at the outlet of the combustion chamber, may be disposed elsewhere in the combustion chamber if desired.

Muffler 25 more fully described hereinafter is disposed downstream of the combustion chamber 19. The muffler 25 is arranged and adapted to attenuate the waves generated in the combustion chamber optimally for an input wave amplitude and pulse frequency. Mufflers of the type used for attenuation in pulsed lasers are suitable.

Figure 2:
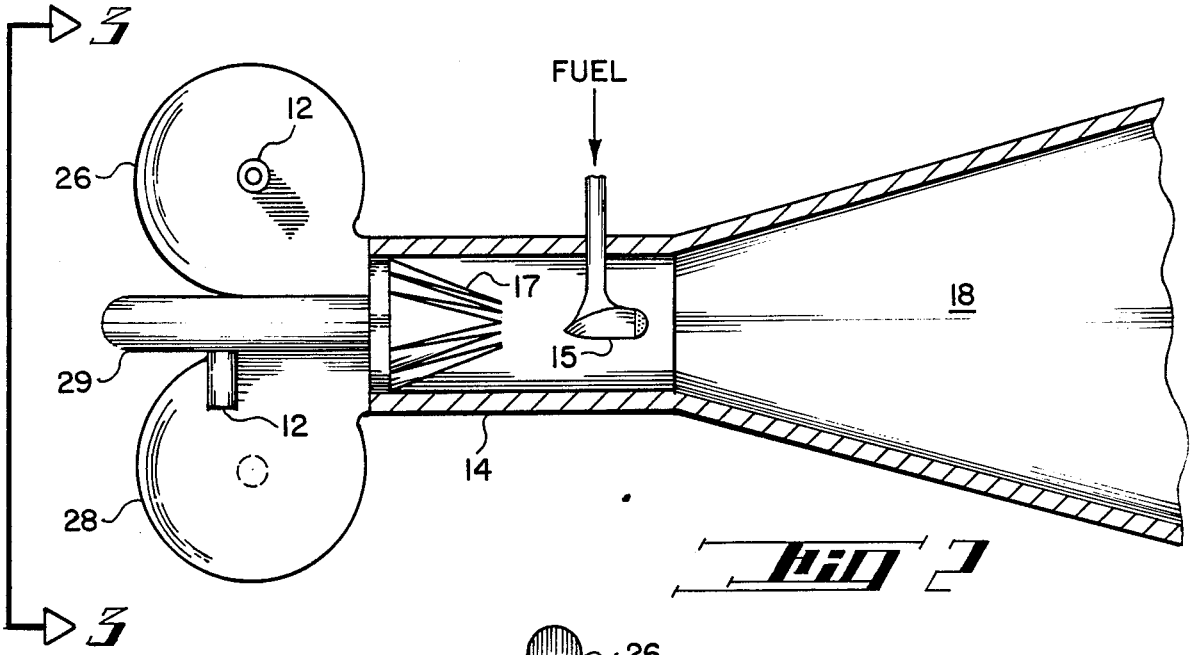
FIG. 2 is a side elevation showing multiple vortex diode configuration.
Figure 3:
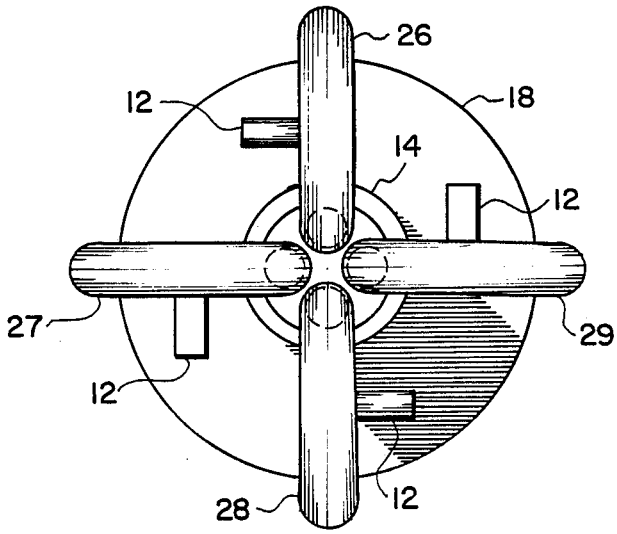
FIG. 3 is an end view taken on line 3—3 of FIG. 2.

As shown in FIGS. 2 and 3 multiple vortex diodes 26-29 may be utilized to optimize performance. The use of a plurality of vortex diodes is advantageous in that this permits a reduction in the size of each diode as compared to the use of a single diode and this has the additional benefit of reducing transit time.

Figure 4:
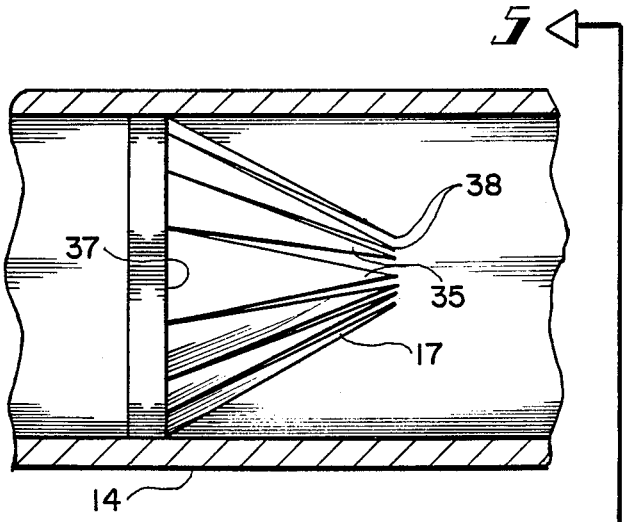
FIG. 4 is a side elevation partly in cross section and on an enlarged scale of the flow diode shown in FIG. 1.
Figure 5:
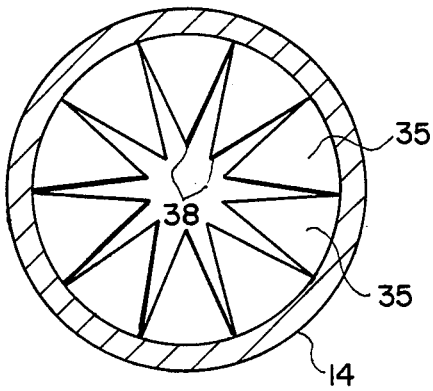
FIG. 5 is an end view of the flow diode taken on line 4—4 of FIG. 4.

Flow diode 17, shown on an enlarged scale in FIGS. 4 and 5 comprises a series of triangular members 35 with their bases 37 carried by the wall of duct 14, (which may be of any desired cross section) and their apexes 38 pointing downstream. Thus, the triangular members 35 are disposed at an angle to the wall such that their apexes 38 are spaced away from the wall. The angle at which the triangular members 35 are disposed from the wall should be between five and twenty degrees. The flow over the triangular members 35 is significantly different for flow in opposite directions. The triangular members are sized, shaped and disposed at an angle or angles providing a maximum ratio of high flow resistance in the upstream direction and low flow resistance in the downstream direction.

As air flows in the downstream direction the triangular members 35 generate vortices that direct high energy core or central flow to the walls whereas when air flows over the triangular members in the upstream direction the triangular members 35 generate different vortices that cause low energy flow at the walls to be separated therefrom. This generates high velocity vortex flow over at least a substantial portion of the duct cross section and especially in its central portion. This is effective to produce energy losses in upstream flow and thus a high resistance to such flow upstream of the flow diode.

Where combustor operating conditions remain fixed, the triangular members 35 may be fixedly attached to the duct walls. However, if desired, they may be movably carried by the duct wall whereby, in conventional manner, their positions within the duct may be varied as circumstance may require or as may be desired.

In the embodiment shown the members 35 provide the additional function of insuring rapid mixing of the air and injected fuel.

Flow diode 17 may be used singly, a plurality may be used spaced one from another a distance to maximize energy losses between them, and with or without vortex diodes. Maximum reduction of undesired upstream flow is, however, achieved when the flow diodes are used in combination with vortex diodes because of the uniquely beneficial effect the flow diodes produce at the inlet of and within the vortex diodes.

For a fifty megawatt thermal combustor, the peak pressure rise in the combustion chamber can be expected to be about thirty to forty pounds per square inch with an average pressure of about five to twenty pounds per square inch gauge versus a loss in pressure of about one pound per square inch present in prior art devices.

The use of particle entrainment and/or a muffler may be used to tailor the spectral content of the pressure into a staged particle heater/separator unit. The requirements for muffler technology are set by separator structural dynamics where used.

Since the high pulsed overpressure occurring during operation produces sonic backflow, choking must be provided at the innermost radius of the vortex diode. If this is not done the vortex pressure drop will not limit backflow. A suitable ratio of resistance is about fifty to one hundred. Where necessary to assist in providing the necessary ratio, steam injection to energize the boundary layers and/or transient steam counter flow as an ejector may be used.

In the operation of pulsed lasers a rapid energy deposition of a few microseconds can create overpressures of approximately one to five atmospheres. If good optical laser performance is to be provided on the next laser pulse, such overpressures must be damped to where the density perturbations are about 0.00004 in less than about five microseconds. These laser requirements, while more stringent, are analogous to those suitable for practice of the invention.

The present invention may be embodied in other specific forms without departing from the spirit and scope thereof and, accordingly, reference should be made to the appended claims, rather than to the foregoing specification as indicating the scope of the invention.

I claim:

1. An acoustically nonresonant pulse combustor comprising:

(a) aerodynamic vortex diode means having an air inlet port and an air outlet port, said diode means providing a low pressure drop for air flow from said inlet port to said outlet port and a substantially higher pressure drop for air flow from said outlet port to said inlet port, said inlet and outlet ports each having a cross section to provide a ratio of resistance to air backflow of about fifty to one hundred;

(b) means for providing a source of air at a pressure greater than atmospheric pressure;

(c) means for coupling said diode means to said source of pressurized air;

(d) a combustion chamber having an inlet end and an exhaust end, the said inlet end having a cross section larger than that of said diode means outlet port;

(e) duct means including diffuser means connecting said diode means outlet port and said combustion chamber inlet end;

(f) fuel injection means for sequentially injecting fuel into said duct means;

(g) ignition means for sequentially igniting fuel-air mixtures in said combustion chamber with peak pressures of at least about thirty pounds per square inch; and (h) muffler means coupled to said combustion chamber exhaust end for receiving and exhausting gas from said combustion chamber and damping acoustic waves eminating therefrom, said muffler means nonresonantly exhausting said exhaust gas.

2. A pulse combustor as called for in claim 1 wherein said diffuser means increases in cross section from said diode means outlet to said combustion chamber inlet.

3. A pulse combustor as called for in claim 1 wherein said muffler means attenuate acoustic waves generated in said combustion chamber upon ignition of a fuel-air mixture therein.

4. A pulsed combustor as called for in claim 1 wherein said diode means comprises an annularly shaped vortex diode having said inlet port at its center and said outlet port at its periphery.

5. A pulse combustor as called for in claim 4 wherein said diode means includes a plurality of vortex diodes.

6. A pulse combustor as called for in claim 4 and additionally including flow diode means in said duct means disposed between said diode outlet port and said diffuser means, said flow diode means including means for causing flow along the walls of said duct means and upstream towards said flow diode means to be separated therefrom as vortex flow and produce resistance to flow in said upstream direction.

7. A pulse combustor as called for in claim 6 wherein said flow diode means comprises a plurality of triangular shaped members each having a base portion adjacent said duct means wall and an apex portion pointing in the direction of said diffuser means.

8. A pulse combustor as called for in claim 7 wherein said apex portions are spaced from said duct means wall a distance greater than that of said base portions.

9. A pulse combustor as called for in claim 8 wherein said triangular shaped members generate resistance to flow in said duct means toward said diode means substantially greater than that generated for flow in the opposite direction.

10. A pulse combustor as called for in claim 9 wherein said triangular members are disposed at an angle to said duct means walls at about five to twenty degrees.

11. A pulse combustor as called for in claim 10 wherein said fuel injection means is disposed in said duct means between said flow diode and said diffuser whereby resistance to air flow through said flow diode and towards said diffuser means generated by said flow diode provides mixing of said air flow and fuel injected therein through said fuel injection means.

* * * * *